US011998110B2

(12) United States Patent
Monni

(10) Patent No.: US 11,998,110 B2
(45) Date of Patent: Jun. 4, 2024

(54) FOLDABLE AND ELONGATABLE TABLE

(71) Applicant: FOREMOST ITALIA S.r.l., Perugia (IT)

(72) Inventor: Matteo Monni, Umbertide (IT)

(73) Assignee: Foremost Italia, S.r.l. (IT)

( * ) Notice: Subject to any disclaimer, the term of this patent is extended or adjusted under 35 U.S.C. 154(b) by 0 days.

(21) Appl. No.: 17/926,812

(22) PCT Filed: May 27, 2021

(86) PCT No.: PCT/IB2021/054626
§ 371 (c)(1),
(2) Date: Nov. 21, 2022

(87) PCT Pub. No.: WO2021/240417
PCT Pub. Date: Dec. 2, 2021

(65) Prior Publication Data

US 2023/0225499 A1 Jul. 20, 2023

(30) Foreign Application Priority Data

May 29, 2020 (IT) ..... 102020000012838

(51) Int. Cl.
*A47B 3/02* (2006.01)

(52) U.S. Cl.
CPC ..... *A47B 3/02* (2013.01)

(58) Field of Classification Search
CPC .... A47B 3/02; A47B 1/03; A47B 1/08; A47B 2001/035; A47B 2003/045
See application file for complete search history.

(56) References Cited

U.S. PATENT DOCUMENTS

| | | | | |
|---|---|---|---|---|
| 136,167 | A * | 2/1873 | Magoun | A47B 3/02 108/118 |
| 283,119 | A * | 8/1883 | Knapp | A47B 3/087 5/115 |
| 2,706,829 | A * | 4/1955 | Charnin | A47B 3/02 16/376 |
| 10,709,234 | B1 * | 7/2020 | Brennan | A47B 41/02 |
| 2012/0204770 | A1 * | 8/2012 | Grace | A47B 3/002 108/118 |
| 2014/0090582 | A1 | 4/2014 | Grace | |
| 2023/0225499 | A1 * | 7/2023 | Monni | A47B 1/08 108/69 |

FOREIGN PATENT DOCUMENTS

CN 201920032 U 8/2011

* cited by examiner

*Primary Examiner* — Matthew W Ing
(74) *Attorney, Agent, or Firm* — Endurance Law Group PLC

(57) ABSTRACT

A table has a first, a second and a third leg pair, the third pair being movable via telescopic connections between a first position proximal to the second pair and a second position distal to the second pair. In a folded table configuration, the third leg pair is in the first position, a first leg and a third leg have relative free ends near a rest plane, and the leg pairs flank one another. In an extended table configuration, the third leg pair has the first position, the first leg and the third leg have relative free ends distant from the rest plane, and the legs delineate a cross. In an elongated table configuration, the third leg pair has the second position, the first leg and the third leg have relative free ends distant from the rest plane, and the leg pairs flank one another in a cross configuration.

9 Claims, 8 Drawing Sheets

XY2
26a 2
2b
21
5b
R3
5
R
5a
7a
13
8a
40a
11
16
17
28
15
4b
R2
43
40c
26b
7b
6b
10
4
19
26
6
9
28
14
18b
18a
8
B
R1
3
3b
7
3a
8
XY1
1

FOLDABLE AND ELONGATABLE TABLE

FIELD OF THE INVENTION

The present invention relates to the technical sector concerning foldable tables. In particular, the present invention relates to a foldable and elongatable table.

DESCRIPTION OF THE PRIOR ART

Use of a foldable table is known, comprising: a rest plane; a first pair of legs arranged at a first side of the rest plane; a second pair of legs that is arranged at a second side of the rest plane, which second side is opposite and parallel to the first side.

The first pair of legs comprises a first leg and a second leg which are rotatably coupled to one another at a relative first intermediate point so as to rotate with respect to one another in a first plane that is transversal to the rest plane and the first leg is rotatably coupled to the rest plane so as to rotate with respect thereto. Further, the second pair of legs comprises a third leg and a fourth leg which are rotatably coupled to one another at a relative second intermediate point so as to rotate with respect to one another in a second plane that is transversal to the rest plane and the third leg is rotatably coupled to the rest plane so as to rotate with respect thereto.

In detail, the known foldable table can assume:

a folded configuration in which the first leg and the third leg are arranged with respect to the rest plane in such a way that the relative free end is near to the rest plane and the first leg, the second leg, the third leg and the fourth leg are arranged in such a way as to be flanked to one another;

an extended configuration in which the first leg and the third leg are arranged with respect to the rest plane in such a way that the relative free end is moved away from the rest plane and the first leg, the second leg, the third leg and the fourth leg are arranged in such a way that the first pair of legs and the second pair of legs delineate, respectively, a cross.

This type of foldable table is of a size to be able to set two places on the rest plane and therefore seat two people at the foldable table.

This type of foldable table is particularly used in hotel or restaurant establishments, as a large number of the foldable tables can be stored in their folded condition in stores having only small spaces available, in particular in closed periods, or if the foldable tables are used outdoors, on days where the weather is not sunny.

However, in particular in hotel or restaurant establishments, there is often a need to be able to set more than two places on the rest plane, as a larger number of customers might wish to be seated at a same foldable table.

Consequently, with the aim of seating more people about a table of this type, more than one table would have to be arranged, in the relative extended configuration, one by the side of another.

Therefore, the hotel or restaurant establishments must have a plurality of foldable tables of the above-described type available.

Further, the fact of having to provide a further table and arrange it by the side of another table leads to inconvenience not only for the customer but also for the waiter who will have to perform the task.

SUMMARY OF THE INVENTION

In the light of the above, the aim of the present invention consists in obviating the above-mentioned drawback.

The above aim is attained by a foldable and elongatable table according to claim 1.

The rotation coupling of a leg with respect to the other of the first pair of legs, of the second pair of legs and of the third pair of legs and, further, the rotation coupling of the first leg and the third leg with respect to the rest plane, together with the first telescopic connection and the second telescopic connection, advantageously enable the foldable and elongatable table to assume the folded configuration, the extended configuration and the elongated configuration.

The rotation coupling enables the rotation of the legs of the first pair of legs, of the second pair of legs and third pair of legs so that they can be arranged to assume the folded configuration, with the purpose of being able to store, in the warehouse, the foldable and elongatable table, and to assume the extended configuration with the purpose of being able to use the foldable and elongatable table.

At the same time, the first telescopic connection and the second telescopic connection enable moving the fifth leg with respect to the first leg and the sixth leg with respect to the second leg so that the third pair of legs is movable between a first position proximal to the second pair of legs and a second position distal to the second pair of legs.

Consequently it is possible to arrange the foldable and elongatable table in the elongated configuration, should it be desired to increase the relative extension of the rest plane: in fact, it is possible to arrange a supplementary portion of the rest plane resting on the free end of the fifth leg and the sixth leg and the third pair of legs is in the second position.

BRIEF DESCRIPTION OF THE DRAWINGS

Specific embodiments of the invention will be described in the following part of the present description, according to what is set down in the claims and with the aid of the accompanying tables of drawings, in which:

DESCRIPTION OF THE PREFERRED EMBODIMENTS

Figure 1:
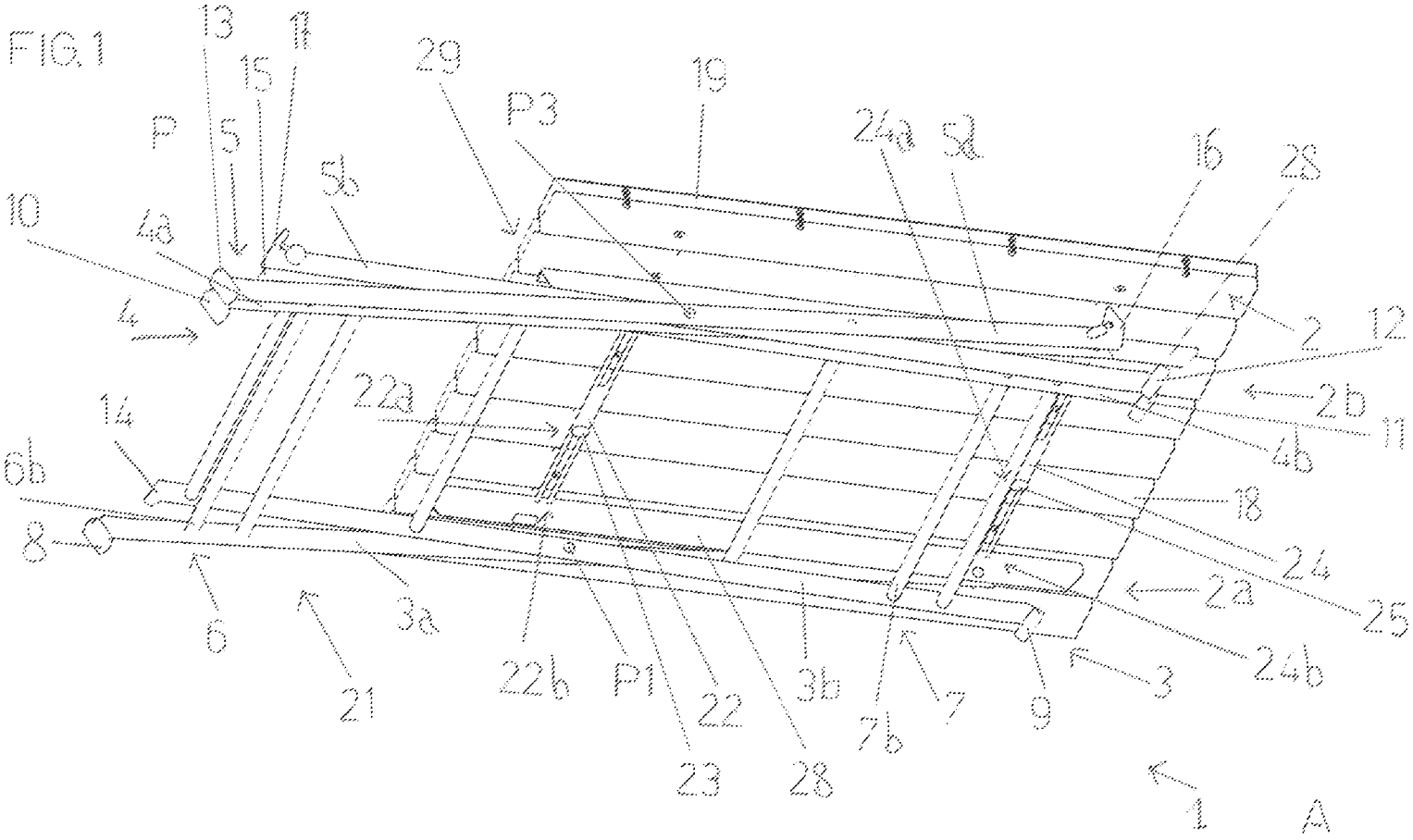
FIGS. 1-3 are perspective views of the foldable and elongatable table object of the present invention, in different positions from the folded configuration to the elongated configuration.

With reference to the appended tables of drawings, reference numeral (1) denotes in its entirety a foldable and elongatable table comprising: a rest plane (2); a first pair of legs (3) that is arranged at a first side (2*a*) of the rest plane (2); the first pair of legs (3) comprising a first leg (3*a*) and a second leg (3*b*) which are rotatably coupled to one another at a relative first intermediate point (P1) so as to rotate with respect to one another in a first plane (XY1) that is transversal to the rest plane (2); the first leg (3*a*) being rotatably coupled to the rest plane (2) so as to rotate with respect thereto (see FIGS. 1, 2, 3, 3A and 5).

Further, the foldable and elongatable table (1) comprises: a second pair of legs (4) that is arranged at a second side (2*b*) of the rest plane (2), which second side (2*b*) is opposite and parallel to the first side (2*a*); the second pair of legs (4) comprises a third leg (4*a*) and a fourth leg (4*b*) which are rotatably coupled to one another at a relative second intermediate point (P2) so as to rotate with respect to one another in a second plane (XY2) that is transversal to the rest plane (2); the third leg (4*a*) being rotatably coupled to the rest plane (2) so as to rotate with respect thereto (see FIGS. 1, 2, 3, 3A and 5).

Figure 1A:
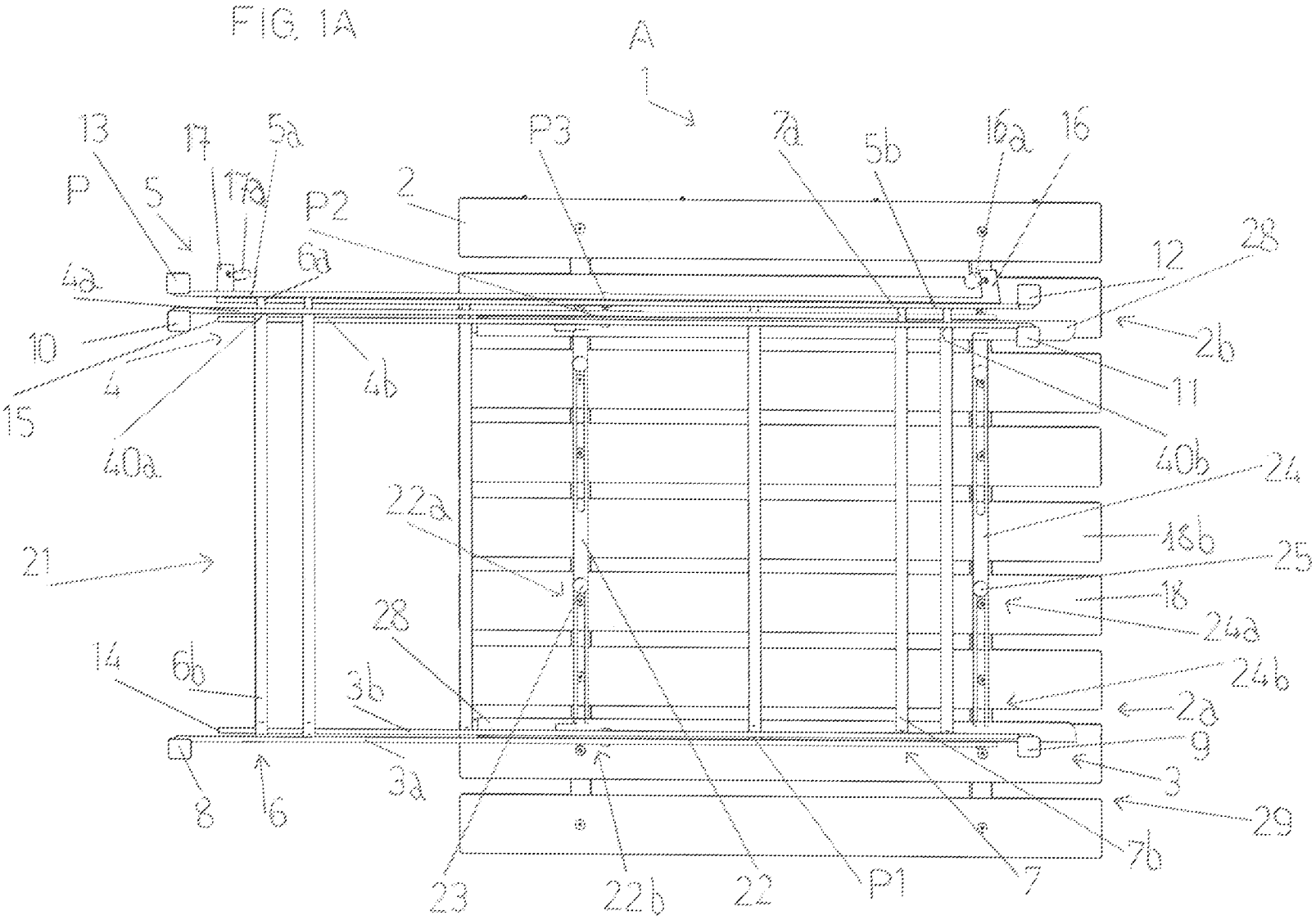
FIG. 1A is a view alike to FIG. 1 from a different side.
Figure 2:
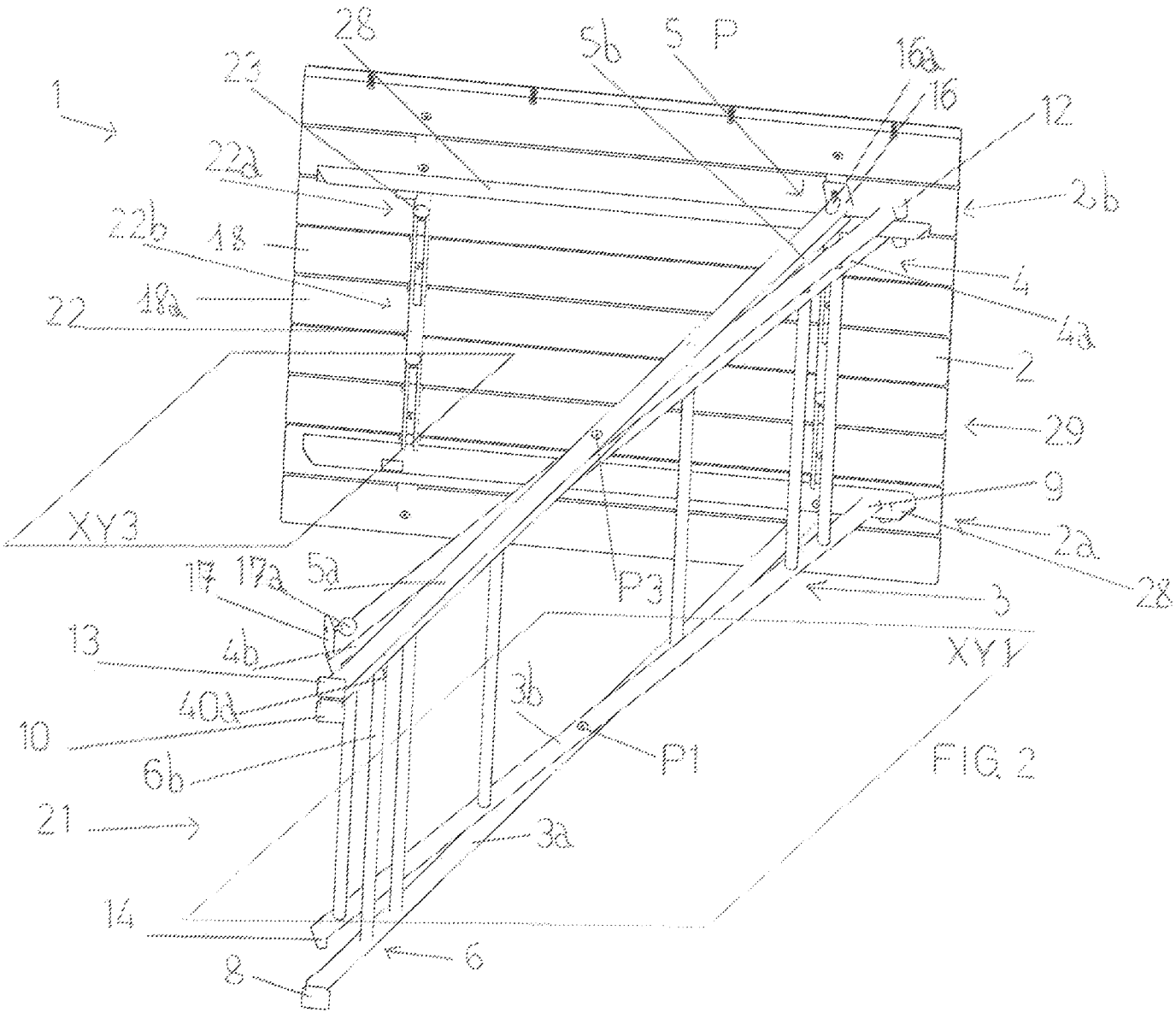
Figure 3:
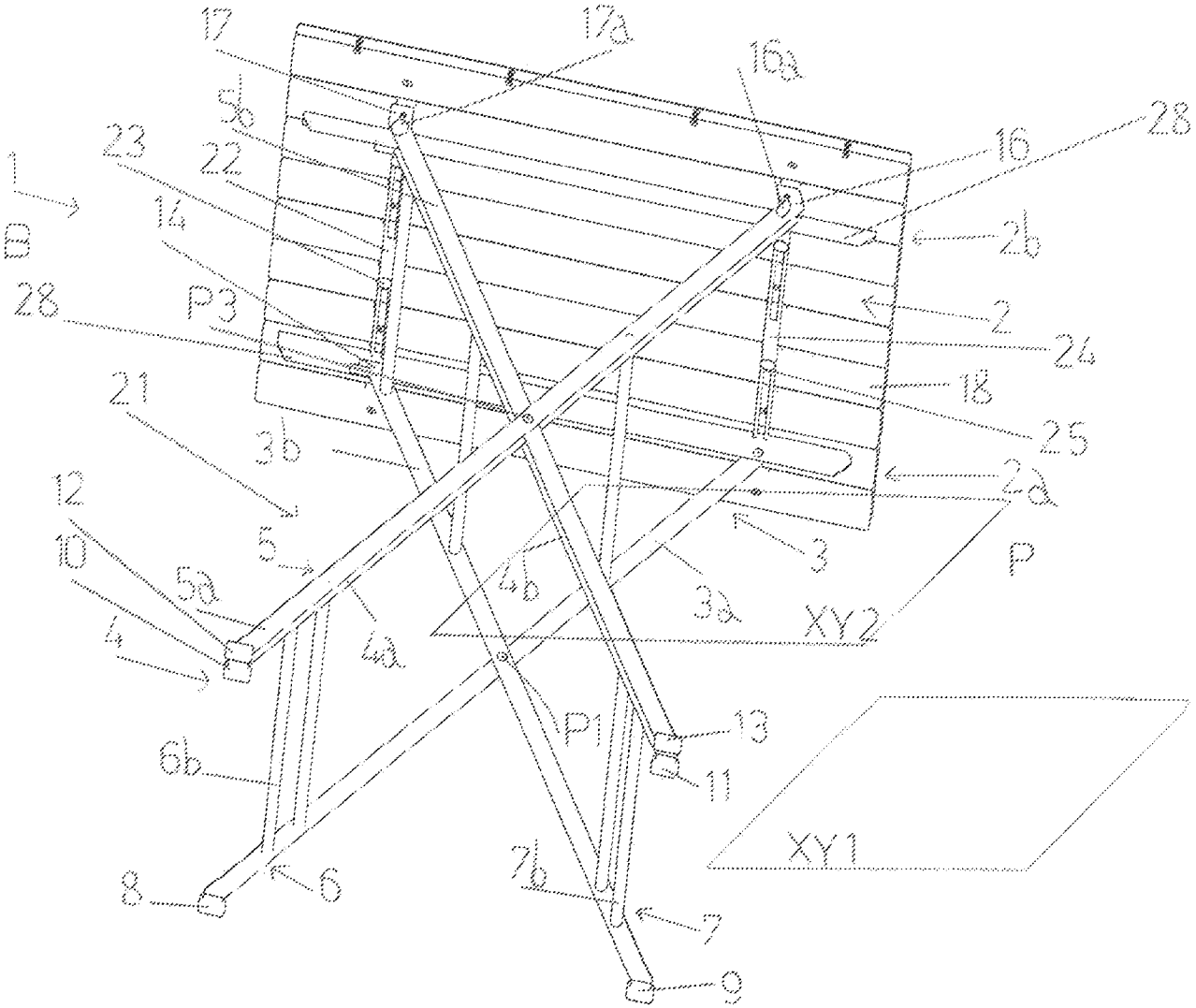
Figure 3A:
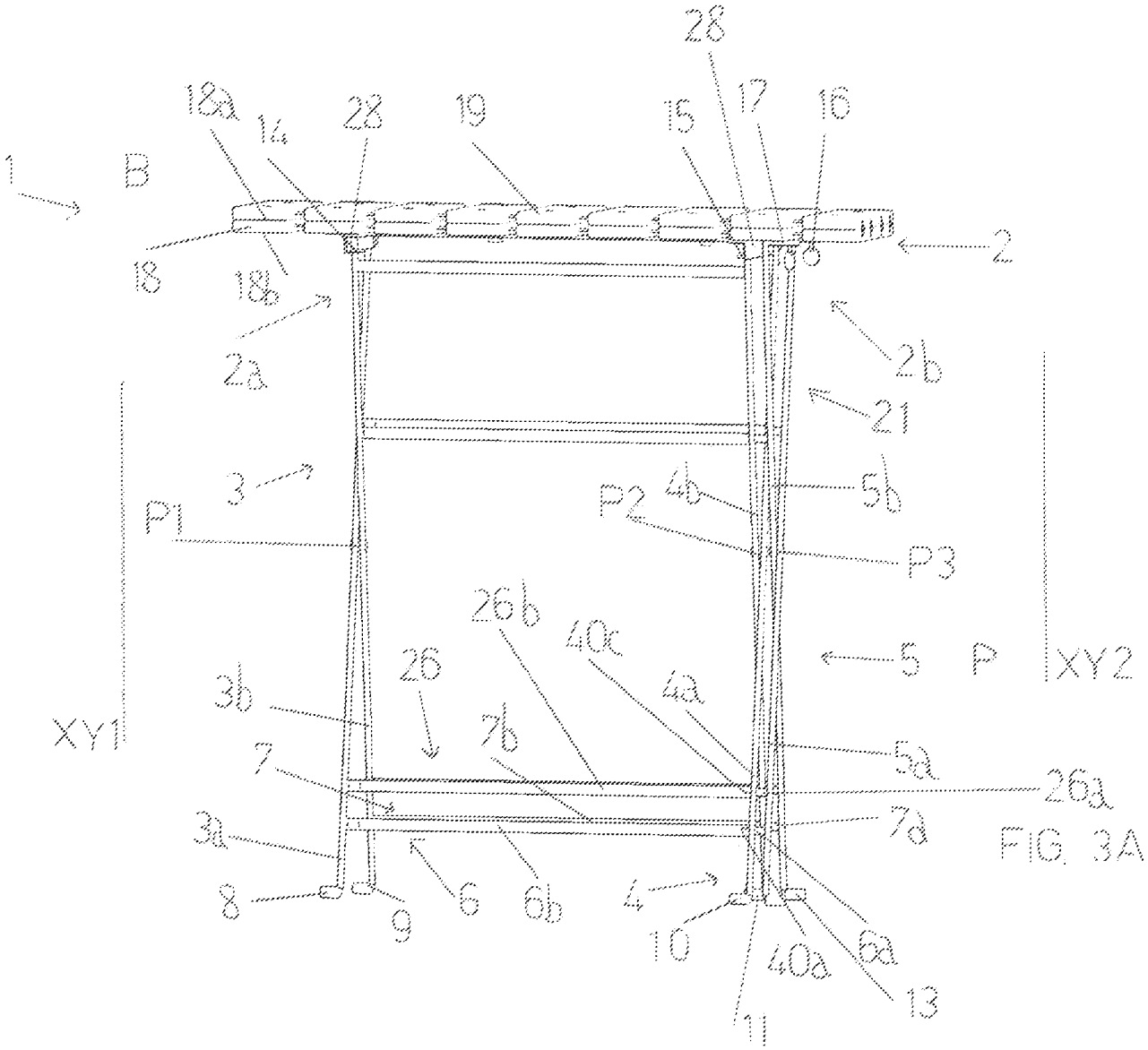
FIG. 3A is a view alike to FIG. 3 from a different side.

Further, the foldable and elongatable table (1) comprises:

a third pair of legs (5) that is arranged at the second side (2*b*) of the rest plane (2);

the third pair of legs (5) comprises a fifth leg (5*a*) and a sixth leg (5) which are rotatably coupled to one another at a relative third intermediate point (P3) so as to rotate with respect to one another in a third plane (XY3) that is transversal to the rest plane (2) (see FIGS. 1, 2, 3, 3A and 5); the third leg (4*a*) comprising a first through-hole (40*a*) and the fourth leg (4*b*) comprises a second through-hole (40*b*) (see FIGS. 1A and 3A);

a first telescopic connection (6) which: comprises a first rod (6*a*) and a first tubular element (6*b*) inside which the first rod (6*a*) is slidable; crosses the first through-hole (40*a*); connects the fifth leg (5*a*) with the first leg (3*a*) in order to enable the fifth leg (5*a*) to move with respect to the first leg (3*a*);

a second telescopic connection (7) which: comprises a second rod (7*a*) and a second tubular element (7*b*) inside which the second rod (7*a*) is slidable; crosses the second through-hole (40*b*); connects the sixth leg (5*b*) with the second leg (3*b*) in order to enable the sixth leg (5*b*) to move with respect to the second leg (3*b*) (see FIGS. 1A and 3A).

The third pair of legs (5) is movable, by means of the first telescopic connection (6) and the second telescopic connection (7), between a first position (P), in which it is proximal to the second pair of legs (4), and a second position (D), in which it is distal to the second pair of legs (4) (see FIGS. 3, 3A, 4 and 4A).

Figure 4:
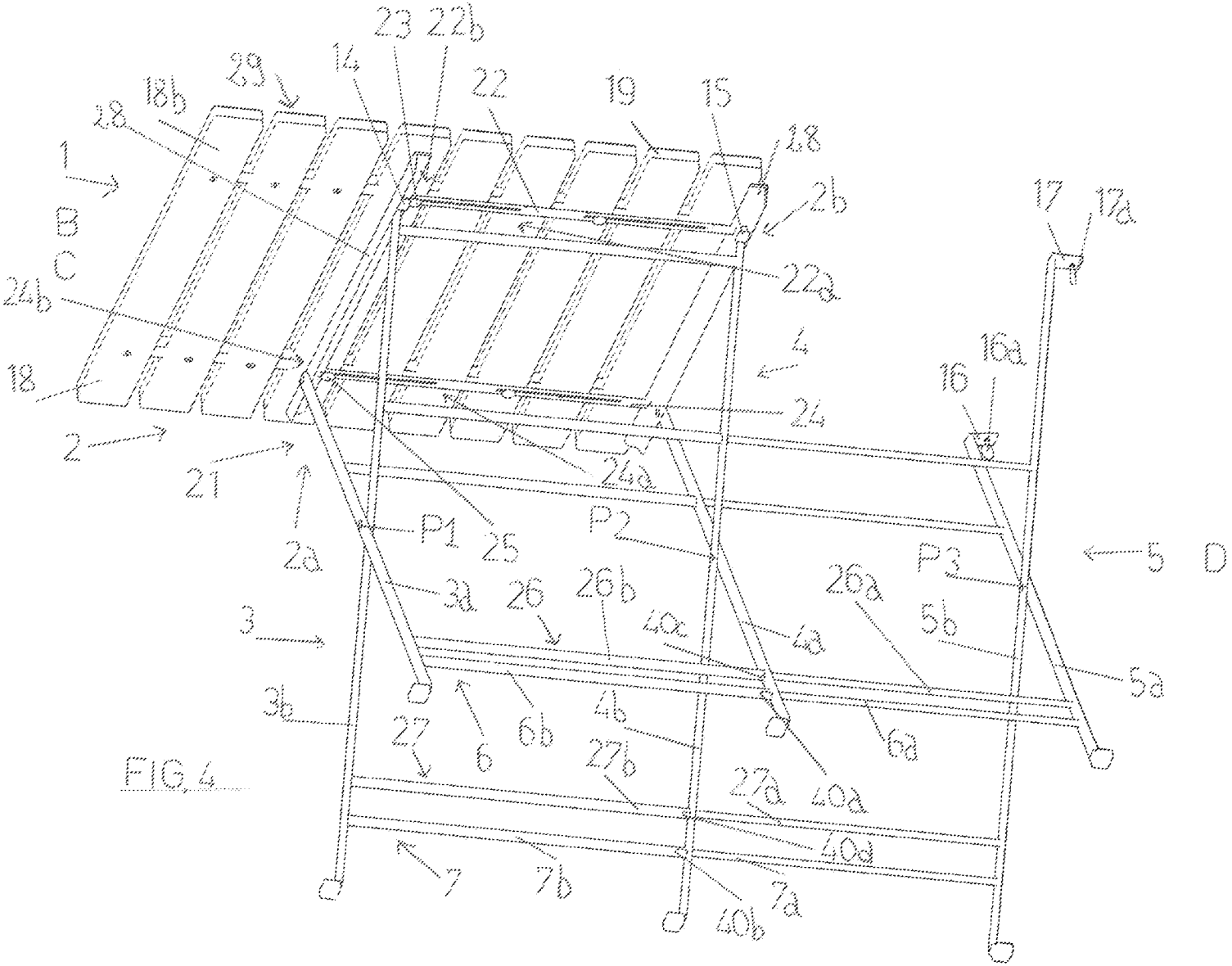
FIGS. 4 and 5 are perspective views of the foldable and elongatable table of the present invention, in further different positions from the extended configuration to the elongated configuration.
Figure 5:
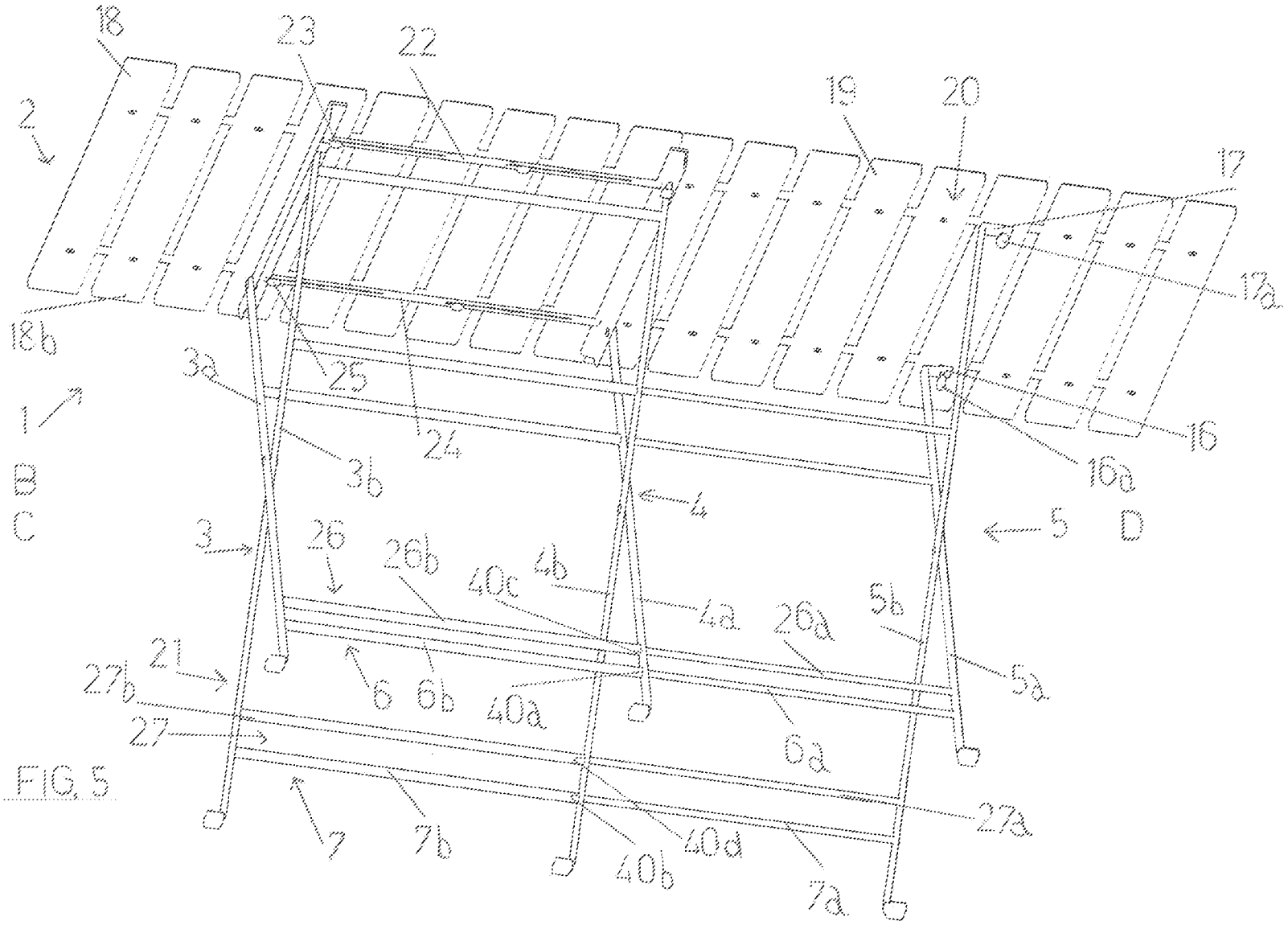

The foldable and elongatable table (1) is configured and predisposed so as to assume:

a folded configuration (A) in which:

the third pair of legs (5) is in the first position (P);

the first leg (3*a*) and the third leg (4*a*) are arranged with respect to the rest plane (2) so that the relative free end is near the rest plane (2);

the first leg (3*a*) and the second leg (3*b*), the third leg (4*a*) and the fourth leg (4*b*) and the fifth leg (5*a*) and the sixth leg (5) are arranged in such a way as to be flanked to one another (see FIGS. 1 and 1A);

an extended configuration (B) in which:

the third pair of legs (5) is in the first position (P);

the first leg (3*a*) and the third leg (4*a*) are arranged with respect to the rest plane (2) in such a way that the relative free end is distant from the rest plane (2);

the first leg (3*a*) and the second leg (3*b*), the third leg (4*a*) and the fourth leg (4*b*) and the fifth leg (5*a*) and the sixth leg (5*b*) are arranged in such a way that the first pair of legs (3), the second pair of legs (4) and the third pair of legs (5) respectively delineate a cross (see FIG. 3);

an elongated configuration (C), wherein:

the third pair of legs (5) is in the second position (D);

the first leg (3*a*) and the third leg (4*a*) are arranged with respect to the rest plane (2) in such a way that the relative free end is distant from the rest plane (2);

the first leg (3*a*) and the second leg (3*b*), the third leg (4*a*) and the fourth leg (4*b*) and the fifth leg (5*a*) and the sixth leg (5*b*) are arranged in such a way that the first pair of legs (3), the second pair of legs (4) and the third pair of legs (5) respectively delineate a cross (see FIGS. 4 and 5).

The first leg (3*a*) can be understood to be a single element or as a plurality of elements arranged flanked to one another and fixed longitudinally to one another (not illustrated).

Like considerations can be made for the second leg (3*b*), the third leg (4*a*) and the fourth leg (4*b*) and the fifth leg (5*a*) and the sixth leg (5*b*).

The first leg (3*a*) and the second leg (3*b*) are hinged to one another at the relative first intermediate point (P1) (see FIGS. 1A and 3A).

The first plane (XY1) can be perpendicular to the rest plane (2).

The first leg (3*a*) can be perpendicular to the rest plane (2).

The first leg (3*a*) can rotate with respect to the rest plane (2) in the first plane (XY1).

The second leg (3*b*) can rotate with respect to the first leg (3*a*) in the first plane (XY1).

The third leg (4*a*) and the fourth leg (4*b*) are hinged to one another at the relative second intermediate point (P2) (see FIGS. 1A and 3A).

The second plane (XY2) can be perpendicular to the rest plane (2).

The third leg (4*a*) can be hinged to the rest plane (2).

The third leg (4*a*) can rotate with respect to the rest plane (2) in the second plane (XY2).

The fourth leg (4*b*) can rotate with respect to the third leg (4*a*) in the first plane (XY1).

The fifth leg (5*a*) and the sixth leg (5*b*) are hinged to one another at the relative third intermediate point (P3) (see FIGS. 1A and 3A).

The third plane (XY3) can be perpendicular to the rest plane (2).

The fifth leg (5*a*) and the sixth leg (5*b*) are hinged to one another at the relative third plane (XY3).

The first rod (6*a*) can slide telescopically with respect to the first tubular element (6*b*) via the first through-hole (40*a*) (see FIGS. 3, 4 and 5).

The first telescopic connection (6) can connect the fifth leg (5*a*), the third leg (4*a*) and the first leg (3*a*) to one another (see FIGS. 3, 4 and 5).

In this way, when the first leg (3*a*) is rotated with respect to the rest plane (2) a rotation is obtained with respect to the rest plane (2), of the third leg (4*a*) in the second plane (XY2) and of the fifth leg (5*a*) in the third plane (XY3).

The second rod (7*a*) can slide telescopically with respect to the second tubular element (7*b*) via the second through-hole (40*b*) (see FIGS. 3, 3A, 4 and 5).

The second telescopic connection (7) can connect the sixth leg (5*b*), the fourth leg (4*b*) and the second leg (3*b*) to one another (see FIGS. 3, 4 and 5).

In this way, when the second leg (3*b*) is rotated with respect to the first leg (3*a*) a rotation of the fourth leg (4*b*) with respect to the third leg (4*a*) in the second plane (XY2) is obtained as well as of the sixth leg (5*b*) with respect to the fifth leg (5*a*) in the third plane (XY3).

The third pair of legs (5) can be movable in a plane that is parallel to the rest plane (2).

In detail, with particular reference to FIGS. 1 and 1A, in the folded configuration (A): the first leg (3*a*) and the third leg (4*a*) are rotated with respect to the rest plane (2) so that the relative free end is near the rest plane (2).

Further, the first leg (3*a*) is rotated with respect to the second leg (3*b*) so that the first leg (3*a*) and the second leg (3*b*) are flanked to one another; the third leg (4*a*) is rotated with respect to the fourth leg (4*b*) so that the third leg (4*a*) and the fourth leg (4*b*) are flanked to one another; the fifth leg (5*a*) is rotated with respect to the sixth leg (5*b*) so that the fifth leg (5*a*) and the sixth leg (5*b*) are flanked to one another.

In detail, with particular reference to FIGS. 3, 3A, in the extended configuration (B): the first leg (3*a*) and the third leg (4*a*) are rotated with respect to the rest plane (2) so that the relative free end is distant from the rest plane (2).

Further: the first leg (3*a*) is rotated with respect to the second leg (3*b*) so that the first pair of legs (3) delineates a cross; the third leg (4*a*) is rotated with respect to the fourth leg (4*b*) so that the second pair of legs (4) delineates a cross; the fifth leg (5*a*) is rotated with respect to the sixth leg (5*b*) so that the third pair of legs (5) delineates a cross.

Figure 5A:
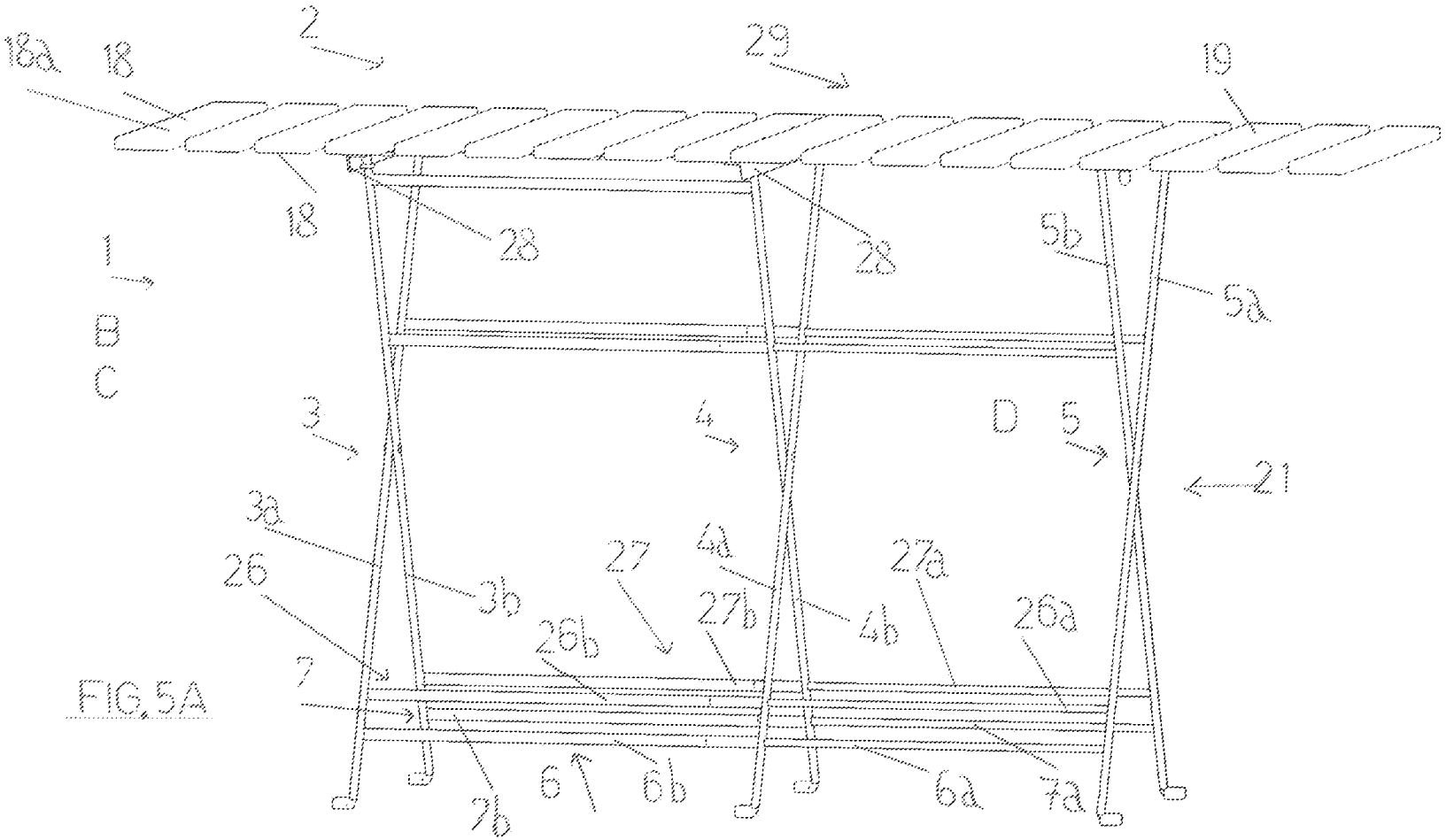
FIG. 5A is a view alike to FIG. 5 from a different side.

In detail, with particular reference to FIGS. 4, 5 and 5A, in the elongated configuration (C): the first leg (3*a*) and the third leg (4*a*) are rotated with respect to the rest plane (2) so that the relative free end is distant from the rest plane (2).

Further: the first leg (3*a*) is rotated with respect to the second leg (3*b*) so that the first pair of legs (3) delineates a cross; the third leg (4*a*) is rotated with respect to the fourth leg (4*b*) so that the second pair of legs (4) delineates a cross; the fifth leg (5*a*) is rotated with respect to the sixth leg (5*b*) so that the third pair of legs (5) delineates a cross.

The first tubular element (6*b*) preferably connects the first leg (3*a*) and the third leg (4*a*) to one another; the first rod (6*a*) extends starting from the fifth leg (5*a*) towards inside the first tubular element (6*b*) in such a way as to slide in the first tubular element (6*b*). The second tubular element (7*b*) connects the second leg (3*b*) and the fourth leg (4*b*) to one another and the second rod (7*a*) extends starting from the sixth leg (5*b*) towards the inside of the second tubular element (7*b*) so as to slide in the second tubular element (7*b*) (see FIGS. 3-5).

The passage from the folded configuration (A) to the extended configuration (B) is advantageously simple and rapid as it will be sufficient to move the first leg (3*a*) and the second leg (3*b*) so that there is also rotation, respectively, of the third leg (4*a*) with respect to the rest plane (2), the fourth leg (4*b*) with respect to the third leg (4*a*) and the fifth leg (5*a*) with respect to the sixth leg (5*b*).

Further, the foldable and elongatable table (1) in the relative extended configuration (B) and elongated configuration (C) will be stable due to the first tubular element (6*a*), to the first rod (6*a*), the second tubular element (7*b*) and the second rod (7*a*), which give greater rigidity to the structure.

The first tubular element (6*b*) and the first rod (6*a*) can have a circular transversal section and a greater extension along a relative main extension axis (see FIGS. 3-5).

When inside the first tubular element (6*b*), the first rod (6*a*) can connect the first leg (3*a*) and the fifth leg (5*a*) to one another.

The first tubular element (6*b*) can have a full portion.

The first rod (6*a*) can insert internally of the first tubular element (6*b*) via the first through-hole (40*a*).

The second tubular element (7*b*) and the second rod (7*a*) can have a circular transversal section and a greater extension along a relative main extension axis (see FIGS. 3-5).

When inside the second tubular element (7*b*), the second rod (7*b*) can connect the second leg (3*b*) and the sixth leg (5*b*) to one another.

The second tubular element (7*b*) can have a full portion.

The second rod (7*a*) can insert internally of the second tubular element (7*b*) via the second through-hole (40*b*).

A free end of the first leg (3*a*), of the second leg (3*b*), of the third leg (4*a*), of the fourth leg (4*b*), of the fifth leg (5*a*) and of the sixth leg (5*b*) preferably respectively comprise a foot (8, 9, 10, 11, 12, 13) for stably resting on a floor or a ground surface when the foldable and elongatable table (1) assumes the extended configuration (B) or the elongated configuration (C) (see FIGS. 3-5).

The foldable and elongatable table (1) advantageously in the relative extended configuration (B) or in the elongated configuration (C), will rest stably on the feet (8, 9, 10, 11, 12, 13) on a floor or a ground surface.

A free end of the second leg (3*b*), of the fourth leg (4*b*), of the fifth leg (5*a*) and of the sixth leg (5*b*) preferably comprise, respectively, an abutment plate (14, 15, 16, 17) for abutting the rest plane (2) when the foldable and elongatable table (1) assumes the extended configuration (B) (see FIGS. 2 and 3).

The rest plane (2) will advantageously rest stably on the abutment plate (14, 15, 16, 17) of, respectively, the second leg (3*b*), the fourth leg (4*b*), the fifth leg (5*a*) and the sixth leg (5*b*), when the foldable and elongatable table (1) assumes the relative extended configuration (B).

In this way, the foldable and elongatable table (1) is certain to be stable in the relative extended configuration (B).

Each abutment plate (14, 15, 16, 17) can contact the rest plane (2).

The rest plane (2) preferably comprises a main portion (18) and a supplementary portion (19) which is hinged to the main portion (18) so as to rotate with respect thereto (see FIGS. 3A, 4, 5 and 5A).

The supplementary portion (19) is advantageously hinged to the main portion (18) so that there is a book-rotation between the two portions.

In this way, it will be simple to arrange the supplementary portion (19) at the third pair of legs (5) in the relative second position (D) and arrange the foldable and elongatable table (1) in the relative elongated configuration (C).

The supplementary portion (19) can contact the abutment plate (16, 17) of the fifth leg (5*a*) and of the sixth leg (5*b*), when the supplementary portion is rotated with respect to the main portion (18) towards the third pair of legs (5) and the foldable and elongatable table (1) is in the elongated configuration (C) (see FIGS. 5 and 5A).

A free end of the fifth leg (5*a*) and of the sixth leg (5*b*) preferably comprise, respectively, an abutment plate (16, 17) provided with fixing means (16*a*, 17*a*) in order to abut the supplementary portion (19) and in order to be fixed thereto by fixing means (16*a*, 17*a*) (see FIGS. 5 and 5A).

When the foldable and elongatable table (1) is in the relative extended configuration (B), translation or sliding movements of the supplementary portion (19) with respect to the third pair of legs (5) are advantageously prevented.

Consequently movements of translation or sliding of the supplementary portion (19) with respect to the main portion (18) are prevented.

When the foldable and elongatable table (1) is in the elongated configuration (C), the abutment plate (16, 17) of the fifth leg (5*a*) and the sixth leg (5*b*) can contact the supplementary portion (19).

The supplementary portion (19) can be provided with a plurality of through-holes (20) arranged in such a way that in the elongated configuration (C), they are at the abutment plate (16, 17) of the fifth leg (5*a*) and the sixth leg (5*b*).

The fixing means (16*a*, 17*a*) can comprise a plurality of screws.

The screws can be conformed to be inserted in the relative through-hole of the plurality of through-holes (20) to fix each abutment plate (16, 17) to the supplementary portion (19) (see FIGS. 5 and 5A).

The foldable and elongatable table (1) preferably comprises a frame (21) in turn comprising: a first guide rail (22) having a first extension direction; a first carriage (23) which bears the main portion (18) and which is slidable along the first guide rail (22); and wherein the supplementary portion (19) is hinged to the main portion (18) along an extension direction that is transversal to the first extension direction of the first guide rail (22) (see FIGS. 1A, 5 and 5A).

The passage from the extended configuration (B) to the elongated configuration (C) will advantageously be simple and rapid as it will be sufficient to slide the first carriage (23) along the first guide rail (22) so that the main portion (18) moves away from the third pair of legs (5).

At this point, the supplementary portion (19) will be rotated with respect to the main portion (18) so that it can abut the abutment plate (16, 17) of the fifth leg (5*a*) and the sixth leg (5*b*).

When the foldable and elongatable table (1) assumes the extended configuration (B), it will have a main extension axis which is parallel to the first extension direction of the first guide rail (22).

With particular reference to FIGS. 1, 1A, 3, 4, 5 and 5A the frame (21) comprises a second guide rail (24) which is arranged opposite and parallel to the first guide rail (22) and a second carriage (25) which bears the main portion (18) and which is slidable along the second guide rail (24).

The second guide rail (24) can have the same first extension direction as the first guide rail (22).

The first guide rail (22) preferably comprises a first endrun stop (22*a*) and a second endrun stop (22*b*), which is arranged facing the first endrun stop (22*a*), so that the first carriage (23) can slide along the first guide rail (22) from the first endrun stop (22*a*) to the second endrun stop (22*b*) and vice versa.

When the foldable and elongatable table (1) is advantageously in the relative elongated configuration (C), movements of translation or sliding along the first extension direction are advantageously prevented, in both one direction and the opposite direction, by effect of the stopping action of the second endrun stop (22*b*) and the abutment plates (16, 17) provided with fixing means (16*a*, 17*a*) at the fifth leg (5*a*) and the sixth leg (5*b*).

The second guide rail (24) can comprise a first endrun stop (24*a*) and a second endrun stop (24*b*), which is arranged facing the first endrun stop (24*a*), so that the second carriage (25) can slide along the second guide rail (24) from the first endrun stop (24*a*) to the second endrun stop (24*b*) and vice versa.

The first guide rail (22) can be interposed between the first pair of legs (3) and the second pair of legs (4) (see FIGS. 1A, 5 and 5A).

The second guide rail (24) can be interposed between the first pair of legs (3) and the second pair of legs (4) (see FIGS. 1A, 5 and 5A).

The first tubular element (6*b*) and first rod (6*a*) can be arranged in proximity of the free end of the first leg (3*a*) (see FIGS. 3, 4, 5 and 5A).

The second tubular element (7*b*) and the second rod (7*a*) can be arranged in proximity of the free end comprising the foot (9) of the second leg (3*b*) (see FIGS. 3, 4, 5 and 5A).

Further, the third leg (4*a*) can comprise a third through-hole (40*c*) and the foldable and elongatable table (1) can comprise a third telescopic connection (26) which: comprises a third rod (26*a*) and a third tubular element (26*b*) inside which the third rod (26*a*) is slidable; crosses the third through-hole (40*c*); connects the fifth leg (5*a*) with the first leg (3*a*) in order to enable the fifth leg (5*a*) to move with respect to the first leg (3*a*).

The third tubular element (26*b*) and third rod (26*a*) can be arranged interposed between the rest plane (2) and the first tubular element (6*b*) and the first rod (6*a*) (see FIGS. 3, 4 and 5).

Further, the fourth leg (4*b*) can comprise a fourth through-hole (40*d*) and the foldable and elongatable table (1) can comprise a third telescopic connection (27) which: comprises a fourth rod (27*a*) and a fourth tubular element (27*b*) inside which the fourth rod (27*a*) is slidable; crosses the fourth through-hole (40*d*); connects the sixth leg (5*b*) with the second leg (3*b*) in order to enable the sixth leg (5*b*) to move with respect to the second leg (3*b*) (see FIGS. 4 and 5).

The fourth tubular element (27*b*) and fourth rod (27*a*) can be arranged interposed between the rest plane (2) and the second tubular element (7*b*) and the second rod (7*a*) (see FIGS. 4 and 5).

The main portion (18) of the rest plane (2) can comprise an upper surface (18*a*) and a lower surface (18*b*) (see FIGS. 3A, 4).

The first guide rail (22) can be arranged at the lower surface (18*b*) (see FIGS. 1, 1A, 3, 3A).

The second guide rail (24) can be arranged at the lower surface (18*b*) (see FIGS. 1, 1A, 3, 3A).

The frame (21) can comprise a pair of bars (28) which extend transversally to the first guide rail (22).

The first leg (3*a*) can be hinged to a bar of the pair of bars (28) so that it rotates with respect to the rest plane (2) (see FIG. 1A).

The third leg (4*a*) can be hinged to the to a bar of the pair of bars (28) so that it rotates with respect to the rest plane (2) (see FIG. 1A).

The pair of bars (28) can be arranged at the lower surface (18*b*).

Each bar of the pair of bars (28) is conformed so as to be able to receive the abutment plate (13, 15) of the free end of the second leg (3*b*) and the fourth leg (4*b*) (see FIGS. 4 and 5).

The first leg (3*a*) and the third leg (4*a*) can be hinged to a bar of the pair of bars (28).

The rest plane (2) can be made of wood or plastic.

The rest plane (2) can comprise a plurality of longitudinal elements (29) which are arranged flanked to one another.

The frame (21) can be made of metal.

The first pair of legs (3), the second pair of legs (4) and the third pair of legs (5) can be made of metal.

The first tubular element (6*b*), the second tubular element (7*b*), the first rod (6*a*) and the second rod (7*a*) can have the main extension axis thereof parallel to the first extension direction of the first guide rail (22).

The first tubular element (6*b*), the second tubular element (7*b*), the first rod (6*a*) and the second rod (7*a*) can be made of metal.

The following is a description of how the passage is made from the folded configuration (A) to the extended configuration (B) and, subsequently, to the elongated configuration (C).

Initially, the first leg (3*a*) and the third leg (4*a*) are rotated with respect to the bars of the pair of bars (28) so as to move the relative free end comprising the foot (8,10) away from the rest plane (2) in order to position the free end on a floor or a ground surface (see FIGS. 1 and 2). At this point, the second leg (3*b*) and the fourth leg (4*b*) are rotated, respectively, with respect to the first leg (3*a*) and the third leg (4*a*)

so as to place the relative free end comprising the foot (9, 11) on the floor or ground surface and so as to place the relative free end comprising the abutment plate (14, 15) in each corresponding bar of the pair of bars (28) at the rest plane (2) (see FIGS. 2 and 3). In this way, the foldable and elongatable table (1) assumes the extended configuration (B). Subsequently, the third pair of legs (5) is moved from the first position (P) to the second position (D), by means of the sliding of the first rod (6*a*) internally of the first tubular element (6*b*) and in the first through-hole (40*a*) and the sliding of the second rod (7*a*) internally of the second tubular element (7*b*) and internally of the second through-hole (40*b*) (see FIGS. 3A and 4). At this point, the first carriage (23) and the second carriage (25) slide along the first guide rail (22) and the second guide rail (24), from the relative first endrun stop (22*a*, 24*a*) to the relative second endrun stop (22*b*, 24*b*), to move the main portion (18) away from the third pair of legs (5) (see FIG. 4); The supplementary portion (19) of the rest plane (2) is rotated with respect to the main portion (18) towards the third pair of legs (5) which are in the second position (D), and the abutment plates (16, 17) of the fifth leg (5*a*) and the sixth leg (5*b*) are fixed using fixing means (16*a*, 17*a*) to the supplementary portion (19) (see FIGS. 5 and 5A). In this way, the foldable and elongatable table (1) assumes the elongated configuration (C).

The invention claimed is:

1. A foldable and elongatable table comprising:

a rest plane;

a first pair of legs that is arranged at a first side of the rest plane, wherein the first pair of legs comprises a first leg and a second leg which are rotatably coupled to one another at a relative first intermediate point so as to rotate with respect to one another in a first plane that is transversal to the rest plane, wherein the first leg is rotatably coupled to the rest plane so as to rotate with respect thereto;

a second pair of legs that is arranged at a second side of the rest plane, which second side is opposite and parallel to the first side, wherein the second pair of legs comprises a third leg and a fourth leg which are rotatably coupled to one another at a relative second intermediate point so as to rotate with respect to one another in a second plane that is transversal to the rest plane, wherein the third leg is rotatably coupled to the rest plane so as to rotate with respect thereto;

a third pair of legs that is arranged at the second side of the rest plane, wherein the third pair of legs comprises a fifth leg and a sixth leg which are rotatably coupled to one another at a relative third intermediate point so as to rotate with respect to one another in a third plane that is transversal to the rest plane, wherein the third leg comprises a first through-hole and the fourth leg comprises a second through-hole;

a first telescopic connection which: comprises a first rod and a first tubular element inside which the first rod is slidable, crosses the first through-hole, and connects the fifth leg with the first leg in order to enable the fifth leg to move with respect to the first leg;

a second telescopic connection which: comprises a second rod and a second tubular element inside which the second rod is slidable, crosses the second through-hole, and connects the sixth leg with the second leg in order to enable the sixth leg to move with respect to the second leg, wherein the third pair of legs is movable, by means of the first telescopic connection and the second telescopic connection, between a first position, in which the third pair of legs is proximal to the second pair of legs, and a second position, in which the third pair of legs is distal to the second pair of legs, the foldable and elongatable table being configured and predisposed so as to assume:

a folded configuration in which:

the third pair of legs is in the first position, the first leg and the third leg are arranged with respect to the rest plane so that respective free ends are located at first positions relative to the rest plane, and the first leg and the second leg, the third leg and the fourth leg and the fifth leg and the sixth leg are arranged in such a way as to be flanked to one another;

an extended configuration in which:

the third pair of legs is in the first position, the first leg and the third leg are arranged with respect to the rest plane in such a way that the respective free ends are located at second positions more distant than the first positions from the rest plane, and the first leg and the second leg, the third leg and the fourth leg and the fifth leg and the sixth leg are arranged in such a way that the first pair of legs, the second pair of legs and the third pair of legs respectively delineate a cross; and an elongated configuration, wherein:

the third pair of legs is in the second position, the first leg and the third leg are arranged with respect to the rest plane in such a way that the respective free ends are located at positions more distant than the first positions from the rest plane, and the first leg and the second leg, the third leg and the fourth leg and the fifth leg and the sixth leg are arranged in such a way that the first pair of legs, the second pair of legs and the third pair of legs respectively delineate a cross.

2. The foldable and elongatable table of claim 1, wherein:

the first tubular element connects the first leg and the third leg to one another;

the first rod extends starting from the fifth leg towards inside the first tubular element in such a way as to slide in the first tubular element;

the second tubular element connects the second leg and the fourth leg to one another; and the second rod extends starting from the sixth leg towards an inside of the second tubular element so as to slide in the second tubular element.

3. The foldable and elongatable table of claim 1, wherein:

a free end of the first leg, of the second leg, of the third leg, of the fourth leg, of the fifth leg and of the sixth leg respectively comprises a foot for stably resting on a floor or a ground surface when the foldable and elongatable table assumes the extended configuration or the elongated configuration.

4. The foldable and elongatable table of claim 1, wherein:

a free end of the second leg, of the fourth leg, of the fifth leg and of the sixth leg comprises, respectively, an abutment plate for abutting the rest plane when the foldable and elongatable table assumes the extended configuration.

5. The foldable and elongatable table of claim 1, wherein the rest plane comprises a main portion and a supplementary portion which is hinged to the main portion so as to rotate with respect thereto.

6. The foldable and elongatable table of claim 5, wherein a free end of the fifth leg and of the sixth leg comprises, respectively, an abutment plate provided with fixing means in order to abut the supplementary portion and in order to be fixed thereto by fixing means.

7. The foldable and elongatable table of claim 5, further comprising a frame in turn comprising:

a first guide rail having a first extension direction;

a first carriage which bears the main portion and which is slidable along the first guide rail; and wherein the supplementary portion is hinged to the main portion along an extension direction that is transversal to the first extension direction of the first guide rail.

8. The foldable and elongatable table of claim 7, wherein the first guide rail comprises a first end-run stop and a second end-run stop, which is arranged facing the first end-run stop, so that the first carriage can slide along the first guide rail from the first end-run stop to the second end-run stop and vice-versa.

9. The foldable and elongatable table of claim 7, wherein the first guide rail is interposed between the first pair of legs and the second pair of legs.

* * * * *